United States Patent [19]

Eddy et al.

[11] Patent Number: 5,065,905

[45] Date of Patent: Nov. 19, 1991

[54] HARDWARE DELIVERY SYSTEM

[75] Inventors: James A. Eddy, Rochester, N.Y.; Alan N. Keller, Alexandria, Va.

[73] Assignee: Xerox Corporation, Stamford, Conn.

[21] Appl. No.: 527,407

[22] Filed: May 23, 1990

[51] Int. Cl.[5] ..... B67D 5/60

[52] U.S. Cl. ..... 222/132; 222/144; 222/363; 222/368; 222/354; 222/355

[58] Field of Search ..... 221/119, 121, 266, 124, 221/133; 222/132, 144, 185, 362, 363, 367, 368, 452, 354, 355

[56] References Cited

U.S. PATENT DOCUMENTS

| | | | |
|---|---|---|---|
| 259,540 | 11/1882 | Hoesman | 222/144 |
| 360,608 | 4/1887 | McKinnon | 222/144 |
| 411,123 | 9/1989 | Harigel | 222/144 |
| 476,610 | 6/1892 | Crary | 222/144 |
| 1,183,111 | 5/1916 | Pettermann et al. | 222/368 |
| 2,199,196 | 4/1940 | Evans | 222/144 |
| 3,204,833 | 9/1965 | Weitzner | 222/368 |
| 3,318,473 | 5/1967 | Jones et al. | 222/185 |
| 3,735,902 | 5/1973 | Zindler | 222/363 |
| 4,582,225 | 4/1986 | Peden et al. | 222/135 |
| 4,681,741 | 7/1987 | Hanaway | 422/100 |
| 4,809,883 | 3/1989 | Pozo | 222/141 |

FOREIGN PATENT DOCUMENTS

| | | | |
|---|---|---|---|
| 517340 | 2/1953 | Belgium | 222/363 |
| 0299732 | 1/1989 | European Pat. Off. | 222/368 |
| 867962 | 5/1961 | United Kingdom | 222/144 |

*Primary Examiner*—Michael S. Huppert
*Assistant Examiner*—Kenneth Bomberg

[57] ABSTRACT

An apparatus for storing, transporting and dispensing hardware to workers at workstations on an assembly line. Specifically, this invention relates to a transportable rotatable dispensing apparatus. Thus, the apparatus can be loaded with supplies, hardware or articles, then transported to a multiplicity of workstations for workers to use in an assembly of a product. The apparatus has a base support and at least one storage unit mounted on top of the support. The storage unit is made up of a number of containers rotatably mounted on the support. Each container has a discharging device which is operator actuated. The discharged articles will drop into a chute that directs the articles to a receiving device mounted on the support. On top of the storage unit is a covering that has a loading device for allowing the containers to be loaded with articles.

7 Claims, 6 Drawing Sheets

HARDWARE DELIVERY SYSTEM

BACKGROUND OF THE INVENTION

1. Field of the Invention

The present invention relates generally to an apparatus for storing, transporting and dispensing hardware to workers at workstations on an assembly line. More particularly, this invention relates to a transportable rotatable dispensing apparatus. Wherein, the apparatus can be loaded with supplies, hardware or parts, then, transported to a multiplicity of workstations for workers to use in an assembly of a product.

2. Description of the Prior Art

There are a wide variety of dispensing devices that store various items ranging from paint to fishing hooks. For example, U.S. Pat. No. 4,582,225, discloses a dental porcelain powder dispenser which may house numerous different shades of porcelain powder where a quantity of a desired shade may be readily and quickly dispensed in small quantities while remaining free of contamination. Moreover, U.S. Pat. No. 4,809,883, discloses a sand dispensing assembly wherein, two different sands are held in two bins in a top section, and a middle section has two sets of dispensing tubes, and a bottom section has discharge funnels. The main application of the invention is to dispense sand into a foundry mold riser. Furthermore, U.S. Pat. No. 3,735,902, discloses a chemical analysis dispenser for measuring out quantities of particular materials in precise and minute amounts, and means to vary the amounts. Finally, U.S. Pat. No. 4,681,741, discloses a reagent dispensing assembly for use in an automated specimen analysis system. Specifically, the invention reduces operator involvement by using a computer-type processor which controls the system so that the various operations are carried out in appropriate sequence and the results of the analysis are recorded with specific reference to the sample analyzed.

Although, these identified dispensing devices work well in a fixed stationary position, none of them are designed to be transported to successive work stations, or move along an assembly line.

Accordingly, in today's international market place, corporations often can not compete against other companies that can assemble products for less cost. Specifically, an area that can cut the costs of assemble involves the inefficiency in resupplying parts, articles and hardware used by the assembly worker to assemble the product. Often, one problem is that workers are required to leave their workstations to obtain the needed hardware to assemble the product; thus shutting down all or part of the assembly line for that time period. It is easy to understand how this situation would increase the cost of producing products.

There are several known solutions to minimize the assembly line shut down time. For example, one such way involves the addition of a supply person. The supply person's sole task is to keep the assembly workers supplied with parts and hardware. Often, though, the supplier will run from station to station with a supply cart and unload supplies at each successive work station. Although this system is an improvement over the prior method, the supply person is still an additional cost to the assembly operation and the amount of unnecessary running around should be minimized.

Therefore, a need exists for an apparatus that can relieve a supply person of the need to walk the supply cart to each assembly worker.

Accordingly, it is the primary object of the invention to provide an apparatus that is easily transported to assembly workers located at workstations without having a worker constantly accompanying the apparatus.

It is another object of the invention to provide an apparatus that can be loaded with, dispense, keep segregated and dispense a wide range of hardware configurations to be used in an assembly process.

It is still another object of the invention to provide an apparatus that is easily manipulated by assembly workers so that a stored item can be easily located among the other stored items, and that the selected item is easily dispensed to the worker.

Therefore, the present invention provides a solution to the described problems and other problems and also offers other advantages over the prior art, and solves other problems associated therewith.

SUMMARY OF THE INVENTION

The present invention comprises an apparatus for storing, transporting and discharging articles to operators located at a plurality of selected workstations. The apparatus comprises a base support member, and a plurality of storage containers indexably mounted to the support for storing articles therein, the containers including means for operator actuatable article discharging therefrom. Moreover, the apparatus has means for receiving articles from the discharging means, whereby an operator will index a selected one of the containers to the receiving means before discharging articles therein. Finally, the apparatus has means for transporting said support and said containers to each workstation in the plurality of workstations.

The invention teaches of a method of using a dispenser apparatus for storing, transporting and discharging articles to operators located along a plurality of work stations, including the steps of: loading a variety of articles into a plurality of storage containers mounted indexably on a base support member; transporting the containers to a first selected workstation; indexing one of the containers to an unloading location; discharging articles from the indexed container; and moving the containers to each of the plurality of work stations and performing the indexing and discharging steps at each workstation.

BRIEF DESCRIPTION OF THE DRAWINGS

In the drawing, in which like reference numerals indicate corresponding parts of preferred embodiments of the present invention throughout the several views.

Figure 1:
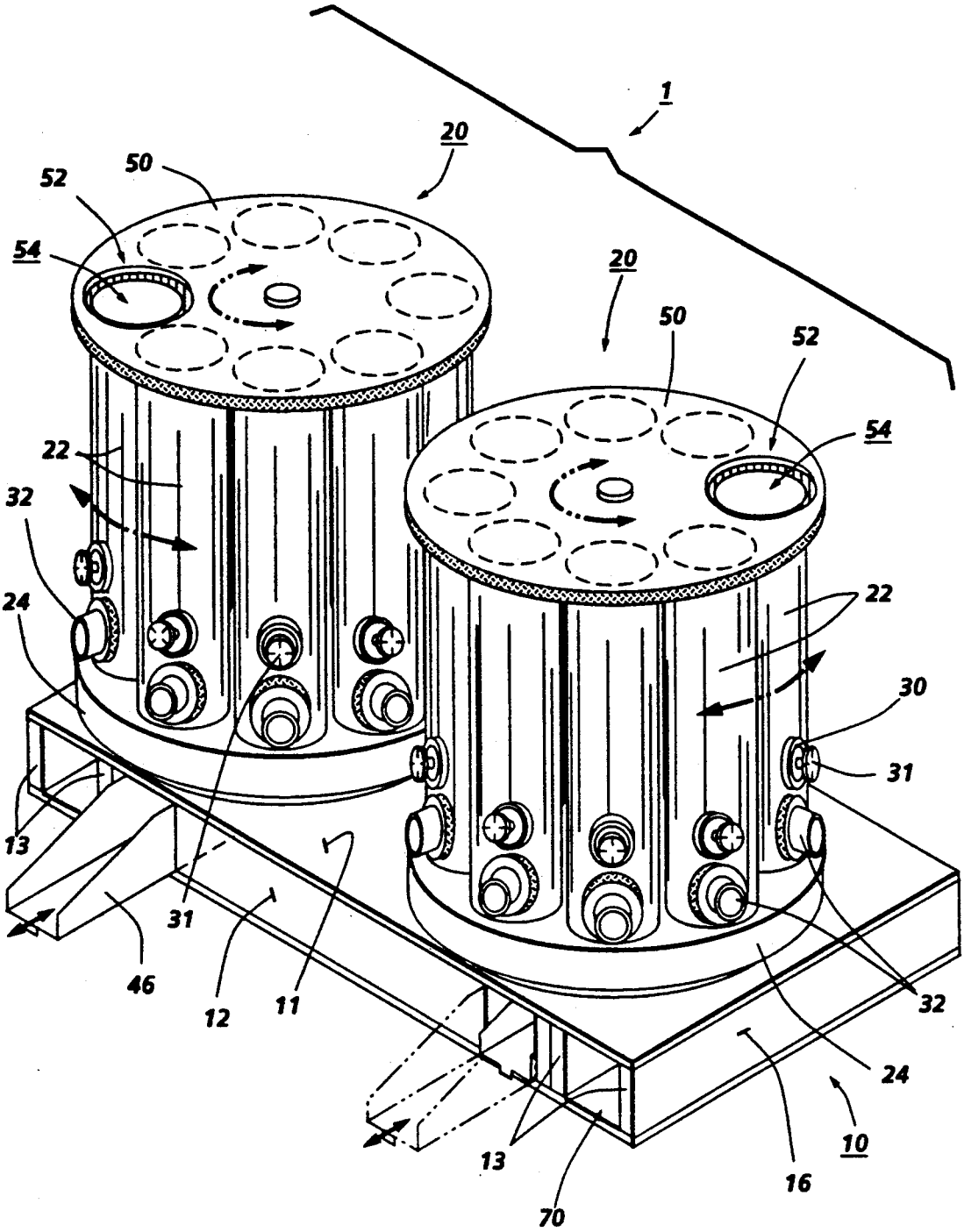
FIG. 1 is a perspective view of the dispensing apparatus.

Other features of the present invention will become apparent as the following description proceeds and upon reference to the drawings.

DETAILED DESCRIPTION OF THE PREFERRED EMBODIMENTS

Although specific terms are used in the following description for the sake of clarity, these terms are intended to refer only to the particular structure of the invention selected for illustration in the drawings, and are not intended to define or limit the scope of the invention.

Referring now to the drawings, and to FIG. 1 in particular, the present invention provides an apparatus for storing, transporting and dispensing hardware. Herein, the apparatus will be referred to as a dispenser 1, or dispensing apparatus. The dispenser 1 comprises a base support member 10. For example, as seen in FIG. 1, the support 10 could be a pallet shaped design having an upper portion 11, a separate lower portion 12, and two spaced apart side support walls 16 on each side of the pallet. Thus, the support 10 would provide stability for articles that are mounted thereon. Alternatively, one skilled in the art will appreciate that there are many types of suitable supports capable of performing the needed function.

Mounted upon the support 10 is at least one storage unit 20. In FIG. 1, two identical storage units are shown.

Each storage unit 20 has a plurality of identical storage containers 22 mounted on the support 10. The storage containers (or just containers) 22 can be arranged in any number of configurations, such as circular, as shown in FIG. 1. Each container 22 will have an opening 52 located on the container's top, allowing for loading of the containers 22 with articles or hardware. Different individual container shapes would be chosen in accordance with the type of articles to be stored therein. Moreover, it is noted, that each of the containers are capable of storing different articles from the next adjacent container. If, for example, the containers 22 were arranged in a circular arrangement, then the individual shape of each container could also be any number of shapes, like a pie shape (not shown); where each pie shaped container would fit tightly next to the adjoining two containers. Thus, by placing the pie shaped containers next to each other in a logical and conventional way, a circle would be formed by the containers 22.

Each storage unit 20, also includes a plate 24, mounted rotatably on support 10. Plate 24 is interposed between the support 10 and the container 22. The plate is designed to function like a "lazy-susan," allowing the containers 22 to rotate relative to the support 10. Thus, as one skilled in the art would easily understand, the plate may have a top plate and a bottom plate having a common central shaft and bearings interposed between the two plates for easy rotatability. This design will allow a user to easily rotate the containers 22 and select which container 22 to dispense articles therefrom; this is called "indexing" the dispenser 1 to the desired storage container 22. In addition, the plate 24 may have a releasable locking mechanism that will hold the plate 24 in an indexed position. One skilled in the art will know of many other ways to accomplish this locking design. For example, a spring loaded ball design, being well known in the art, would work. In operation, the biased ball will be forced so that part of the ball will fit into a prepositioned hole when the indexed container is placed into a certain position corresponding with the indexed container, thus holding the containers in position. To release the biased ball the operator will rotate the containers or index to another container, thus forcing the biased ball out of the hole for easy rotation until another hole is encountered.

Figure 5:
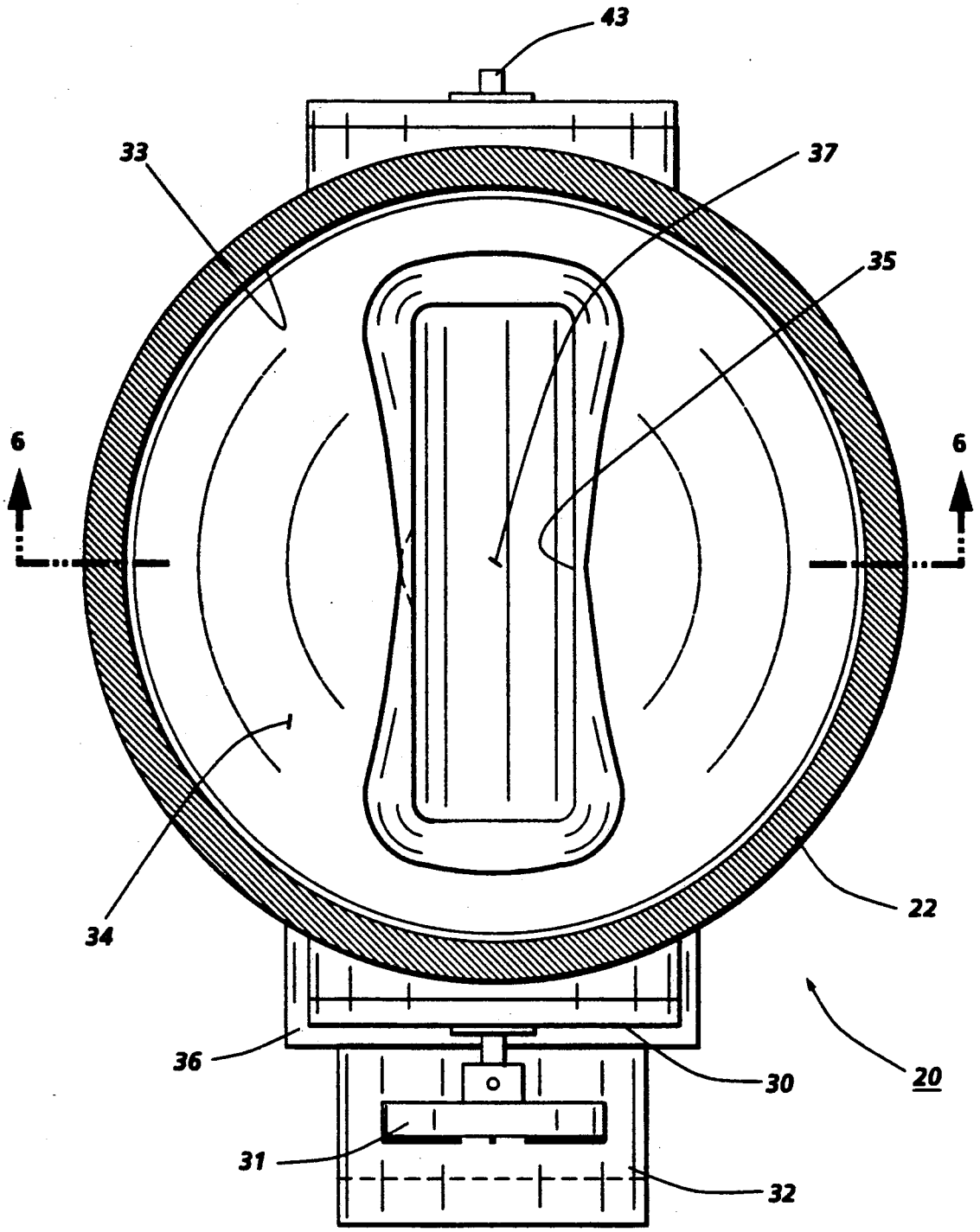
FIG. 5 is a top view of a single container.

Referring to FIG. 5, a top view of a single container is shown. A funnel 34 is mounted inside the container 22 for directing stored articles toward a discharge entrance opening 35 which is covered by rotatably retractable blade 37. The discharger 30 has an exterior housing 36.

Figure 6:
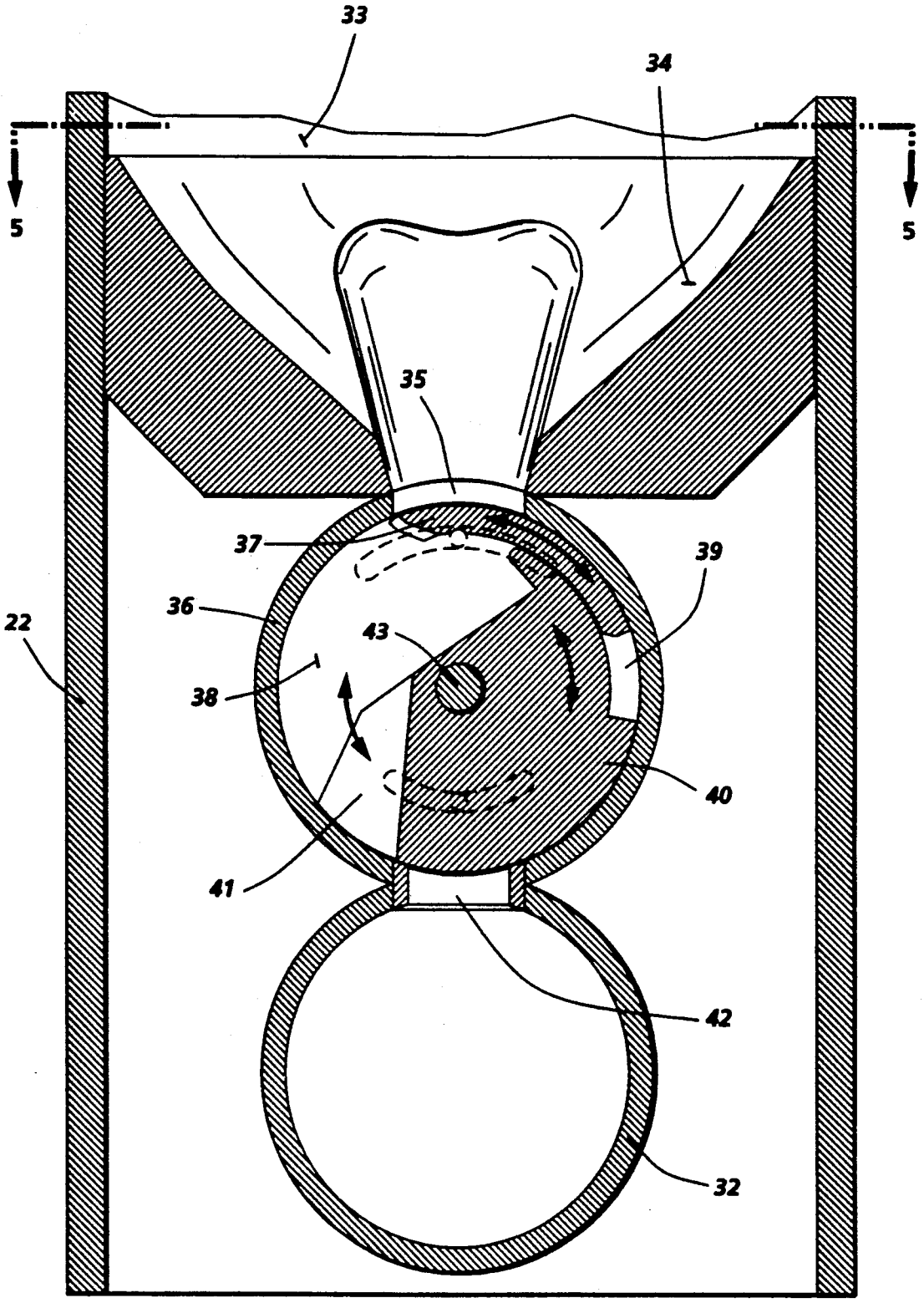
FIG. 6 is a side cross sectional view of a container showing the discharger design.

Referring to FIG. 6, a side cross sectional view of the discharging device 30 as mounted inside the container is shown. Articles stored in upper chamber 33 of the container 22 are directed by funnel 34 to discharger entrance slot 35. Connected to slot 35 is circular discharge housing 36 for containing discharged articles from the upper chamber 33. Positioned adjacent to the slot 35 is rotatably retractable blade 37 which covers the entire slot 35 so that articles in the upper chamber 33 will not enter a discharge chamber 38. However, once the blade 37 is rotatably retracted into cavity 39 chamber 38 will fill with articles from upper chamber 33. Once the articles are in chamber 38, blade 37 can be rotated back to a closed position, thus blocking stored articles from entering chamber 38 through opening 35.

Figure 7:
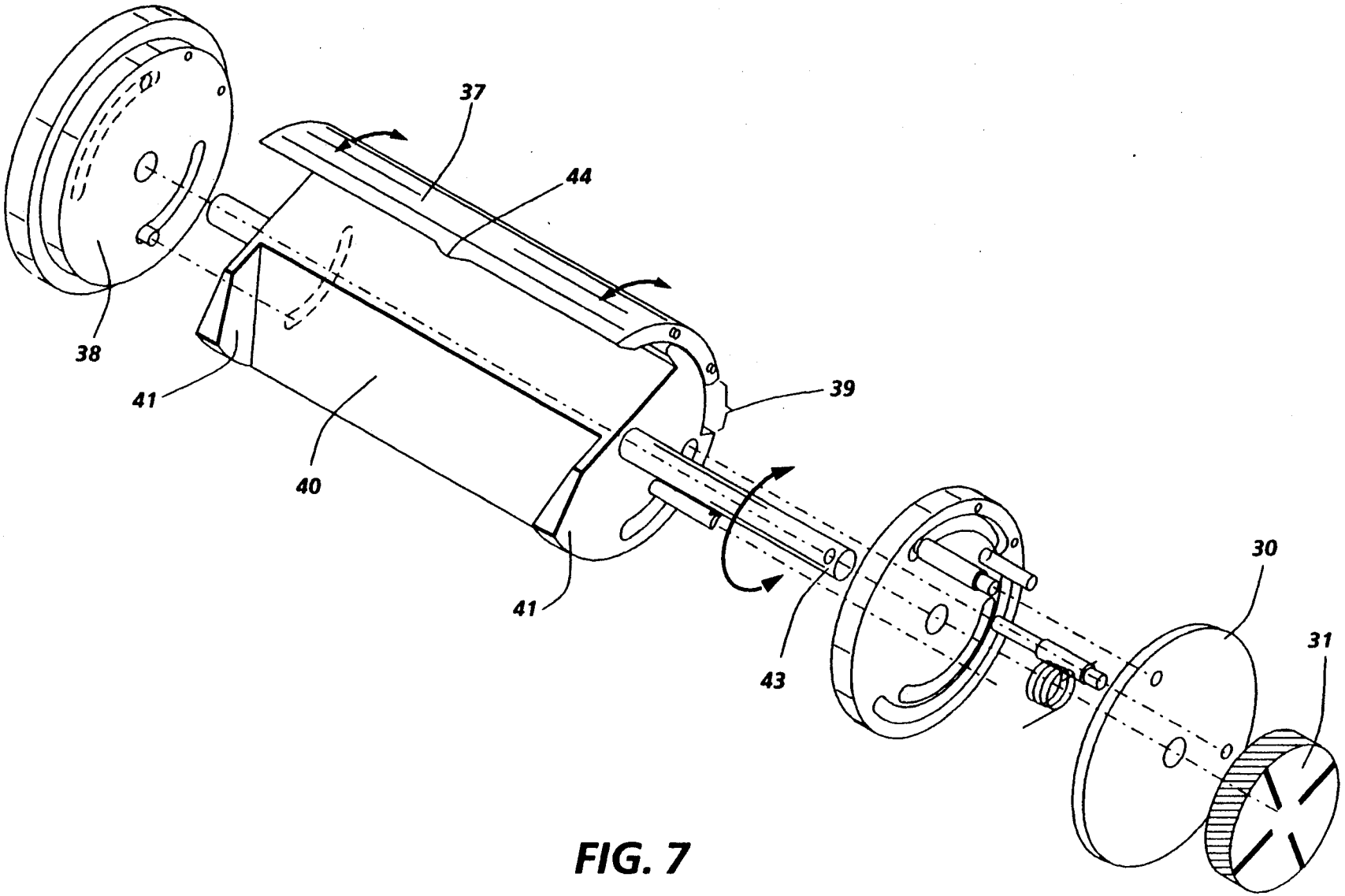
FIG. 7 is a front isometric view of the internal parts of the discharger device.

Body 40 is located in the lower part of chamber 38 and is mounted on shaft 43 which is rotatable. Body 40 closes off a discharge exit port 42, which keeps the articles within chamber 38. To discharge the articles, body 40 is rotated to expose port 42, thus allowing the articles to fall into chute 32 which is connected below the discharging housing 36 and will direct the discharged articles to the outside of container 22. It is noted that rib 44 mounted on blade 37 will keep body 40 from rotating any further since body 40 will abut rib 44. On either end of body 40 are shoulders 41 which aid in directing articles into exit port 42. See FIG. 7 for an isometric view of body 40 and blade 37.

Referring now to FIGS. 1-7, the dispenser handle 31 is operated by rotating it to a first position, thus rotating blade 37 into cavity 39 and opening discharger entrance opening 35 so that articles will fill chamber 38. Next, handle 31 is rotated to a second position where blade 37 closes off opening 35, thus no more articles will enter the chamber 38. Finally, handle 31 is rotated to a third position, where body 40 is rotated from covering port 42, thus allowing articles to discharge into chute 32 and exit the container 22.

Figure 4:
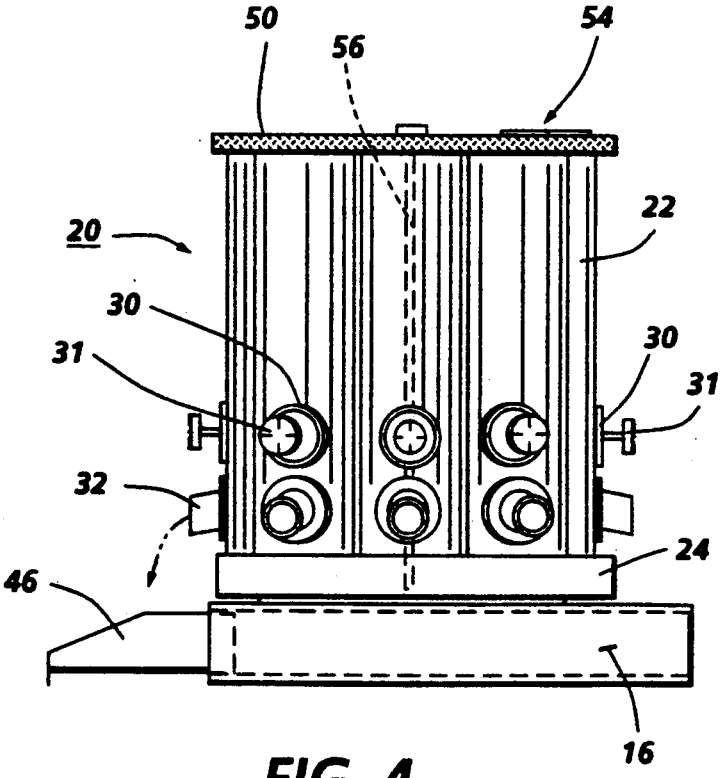
FIG. 4 is an elevational view of the dispensing apparatus showing how stored articles are dispensed into a mounted tray.

Mounted on the support 10 is a receiving device, or simply a receiver 46, as shown in FIGS. 1 and 4. The receiver will catch discharged articles from the discharger 30. As shown in the drawings, the receiver 46 comprises, a tray slidably mounted to the support 10. Moreover, the tray would be dimensioned and located beneath the discharger 30 so that the tray would catch falling articles that were discharged from the indexed storage container. When a container 22 is in a position to discharge articles into receiving device 46 the container is located at an unloading location. It is noted that there are variable designs for the receiving device, each design would be dependent upon the type of article to be discharged from the storage containers 22.

Referring again to FIG. 1, each storage unit 20, further includes a top cover, or simply a cover 50. Operatively connected to the cover 50 is a loading device, or simply a loader 54. The drawing shows the loader 54 to be a hole in the cover 50. However, there are many suitable design variations for the loader 54. For example, a funnel design that would aid in directing articles into the opening 52 would be equally as useful. Each of the loader designs would take into consideration the type of articles to be loaded into the containers 22. Furthermore, the loader 54 should not be restricted to loading just one container 22 at a time. Several containers may be accessed by a loader so designed. In the drawings, the cover 50 is designed to limit the number of container openings 52 exposed, all of the container openings 52 are covered except for one. In addition, the cover is rotatably mounted on top of the containers 22 by attachment to rod 56. Therefore, either the containers 22 will rotate toward the loader 54, or the loader 54 will rotate toward the containers 22. However, there are other suitable cover attachment designs, for example, the cover 50 may be in a fixed position, not able to rotate relative to the support 10. Thus, the containers 22 would have to be rotated into position for loading articles therein. Each design would be apparent in relation to the articles to be loaded and the application for the dispenser 1.

The dispenser 1 is designed to be transported around the factory floor to different workstations 60. Referring now to FIG. 2, option 1, it is seen that the dispenser 1 is transported to assembly line 1. Once there, the dispenser 1 is placed onto the assembly line conveyor 61. Thus, the conveyor 61 will transport the dispenser 1 down the assembly line to the various workstations 60, where workers will index the containers 22 to the desired container and dispense the hardware needed for the assembly of a product being produced on the assembly line.

Figure 2A:
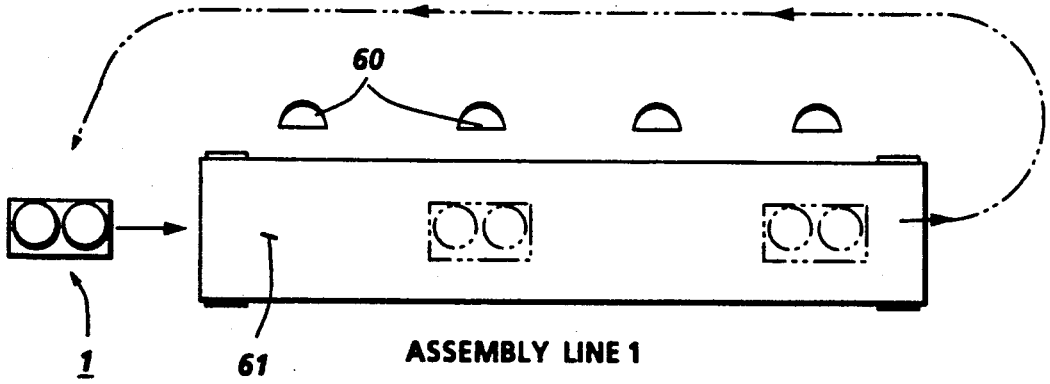
FIG. 2*a* is a representation of a possible pathway to be used by the dispensing apparatus in relation to a single assembly line.

In FIG. 2*a*, all the workstations will have access to the dispenser 1. This is fine if many of the workstations on that assembly line need articles that are stored in the dispenser 1. A problem arises when there is a very large assembly plant with thousands of assembly parts. Thus, it is often easier to load one dispenser 1 with one type of part and its different sizes needed for different assembly lines and then transport the dispenser only to the workstations needing that particular part.

Figure 2B:
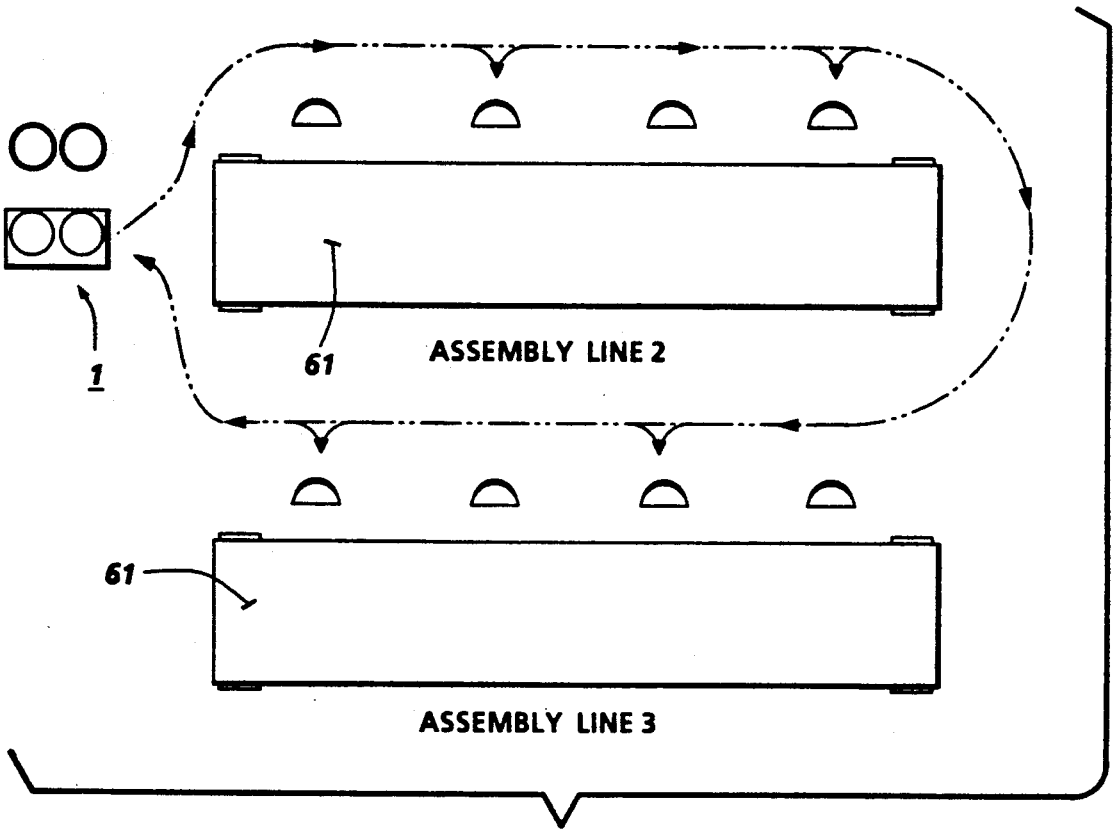
FIG. 2*b* is a representation of a possible pathway to be used by the dispensing apparatus in relation to multiple assembly lines.

FIG. 2*b* displays a way to transport the dispenser 1 only to certain workstations 60 on different assembly lines. Therefore, there can be a separate dispenser for each type of part. One skilled in the art will know that there are many ways to transport the dispenser to the different assembly lines. For example, a preprogrammed robotic cart could transport the dispenser to each workstation 60. As shown in the drawing, the dispenser 1 would be loaded with supply articles that are needed at various locations around the assembly plant. The dispenser would be transported to the workstations needing these supplies where the worker would index the containers having the desired articles and then dispense those articles for use at the workstation. Then the dispenser 1 would proceed to the next workstation and repeat the same steps again.

Figure 3:
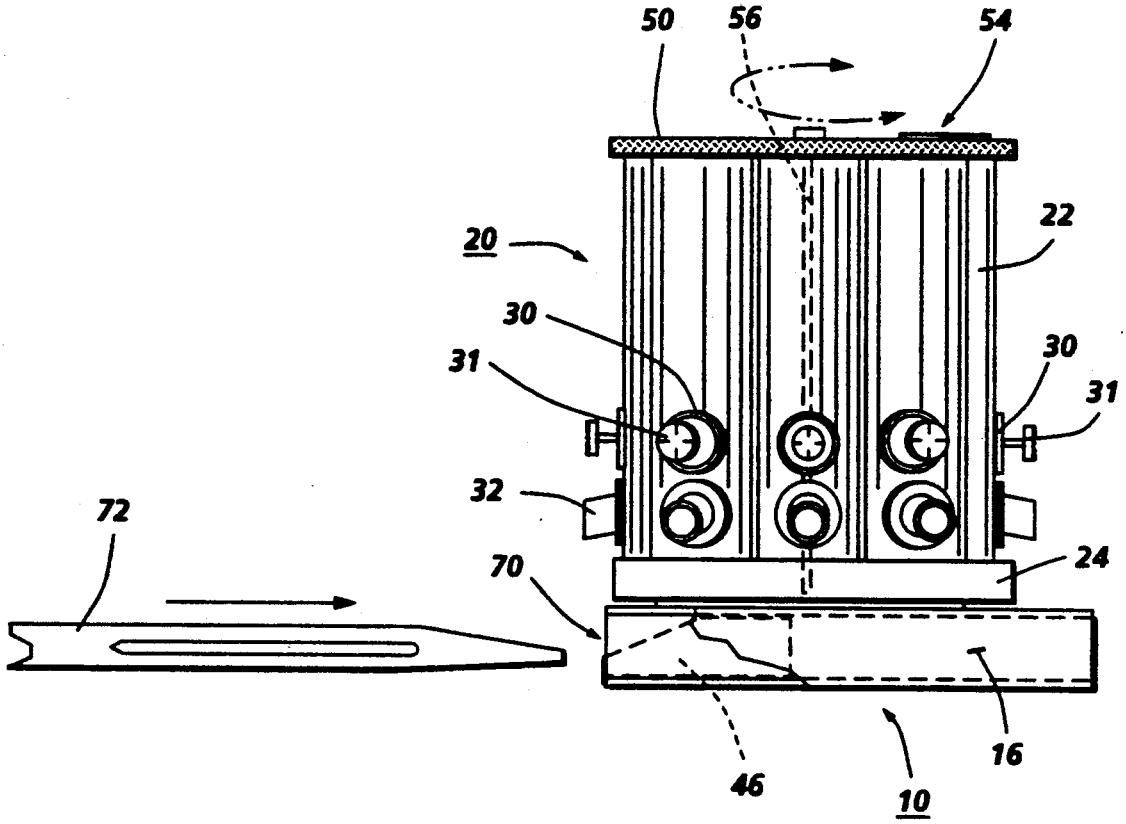
FIG. 3 is a perspective view of the dispensing apparatus showing how a forklift tongue would engage the dispenser.

Referring to FIG. 3, the present invention provides the dispenser with apertures in the support 10 which are adapted to receive tongues 72 of a forklift truck, robotic cart or any other machine adapted to use the apertures for lifting and transporting. Thus, for example, a forklift truck can lift and transport the dispenser to various workstations without the dispenser tipping over.

It is to be understood, however, that even though numerous characteristics and advantageous of the present invention have been set forth in the foregoing description, together with details of the structure and function of the invention, the disclosure is illustrative, and changes in matters of order, shape, size, and arrangement of parts may be made within the principles of the invention and to the full extent indicated by the broad general meaning of the terms in which the appended claims are expressed.

We claim:

1. An apparatus for storing, transporting and discharging articles to operators located at a plurality of workstations, comprising:

a base support member;

at least one storage unit including a plurality of storage containers indexably mounted on said base support member for storing articles therein, each of said storage containers including a discharging means for operator actuatable article discharging therefrom;

means for receiving articles from said discharging means, said receiving means including a retractable tray mounted on said base support member for receiving articles discharged from a selected one of said plurality of storage containers, whereby a selected one of said storage containers is indexed to said receiving means for discharging articles therein; and means for transporting said base support member including said at least one storage unit and said plurality of storage containers to each of the plurality of workstations.

2. An apparatus according to claim 1, wherein each of said containers are capable of storing different articles from the next adjacent container.

3. An apparatus according to claim 1, comprising a means for selectively loading articles into at least one container, wherein said loading means is operatively associated with each of said containers.

4. An apparatus according to claim 1, wherein said receiving means is slidably mounted on said support member in position to receive articles dispensed from a selected one of said plurality of storage containers.

5. An apparatus according to claim 1, wherein said transporting means comprises at least one protrusion extending outwardly therefrom; and said support comprises at least one aperture adapted to receive said protrusion to couple said transporting means with said support.

6. An apparatus according to claim 1, further comprising a rotatably mounted plate in cooperation with said support, and said containers are mounted on said plate.

7. An apparatus according to claim 6, wherein each of said containers comprises a cylinder mounted to said plate with the longitudinal axis in a substantially normal orientation.

* * * * *